United States Patent [19]

Lee et al.

[11] 4,176,449

[45] Dec. 4, 1979

[54] GRIP-OPERATED NAIL CLIPPER

[76] Inventors: George K. C. Lee; Wanda M. Lee, both of 3843 Old Pali Rd., Honolulu, Hi. 96817

[21] Appl. No.: 888,916

[22] Filed: Mar. 22, 1978

[51] Int. Cl.[2] ..... A45D 29/02

[52] U.S. Cl. ..... 30/28

[58] Field of Search ..... 30/28, 124

[56] References Cited

U.S. PATENT DOCUMENTS

| | | | |
|---|---|---|---|
| 3,180,025 | 4/1965 | Tsunemi | 30/124 |
| 3,316,632 | 5/1967 | Bowers | 30/28 |
| 3,855,698 | 12/1974 | Crosby | 30/124 |

*Primary Examiner*—Jimmy C. Peters

[57] ABSTRACT

This original invention, the GRIP-OPERATED NAIL CLIPPER, is a device improving the common (Finger-Operated) Toe-and-Finger Nail Clipper. The invention is the solution to the problem that less dexterous children, aged people, and arthritic and otherwise handicapped people have in manipulating and working the common finger-operated nail clipper. Its simple lever-clamplike action puts the focus of grip-pressure closer and over the nail to be clipped making it easy to control, and the grip action of all five fingers and the palm is much stronger than the normal two-finger common nail clipper. Furthermore, the leverage is increased thus reducing considerably the force necessary to nip the nails clean. Unlike plier-like and other modes of nail clipper where the operating handgrip is opposite the fulcrum hinge and away from the nail being clipped, this invention device works in the direction toward the nail.

3 Claims, 6 Drawing Figures

GRIP-OPERATED NAIL CLIPPER

REFERENCE CITED

U.S. Pat. No. 3,555,675, Jan. 1971, Prokop, J. (class 30, subclass 28).

BACKGROUND OF THE INVENTION

This Invention, the GRIP-OPERATED NAIL CLIPPER, relates generally to the field of hand-held tools and instruments. More specifically, this invention applies to devices to clip or nip human finger and toe nails.

In the common finger-and-toe nail clipper found universally in drug and other retail stores, the instrument is generally a small, compact, folding instrument which is finger-operated when the top bar is reversed to act as a pressure lever arm. However its compactness and design make it difficult for the normal person to insert the clipper cutting edges over the nail to be clipped. It is even more difficult to hold the clipper in place and to exert the necessary pressure on the lever arm to nip the nail clean. The instrument is short, slippery and difficult to grip firmly with just the two finger tips. Besides the normal person the less dexterous child, the aged, the arthritic or poor-sight handicapped people are frustrated in performing this personal chore. The pressure to nip the nail is limited by the shortness of the lever arm designed for compactness. Even in the longer toe nail clipper, the lever action is awkward and unwieldy for the operating (actuating) fingers are even farther away from the nail being clipped.

The Invention is the result of a long effort to devise a simple, inexpensive instrument that (1) can be operated with much less effort, (2) can be better controlled, (3) operated with more fingers and even with palm pressure, (4) compact, and (5) retain the better features of the common clipper.

SUMMARY OF THE INVENTION

To achieve the improvements cited above, the invention takes the form of a simple hand-sized grip clamp, actuating and multiplying the ease necessary to operate the common nail clipper which can be securely fastened within the clamp jaws. In such a new configuration, the Invention accomplishes the following improvements, viz., (1) reduce the effort needed to nip the nail, (2) provide for a full five-finger-and-palm grip over just two finger tips, (3) increase the control over the nail being clipped, (4) retains features of the common nail clipper such as folding lever arm, folding file, existing tool dies and technology, (5) add a fold safe feature when not in use, and (6) keep it simple for inexpensive fabrication.

The Invention is a simple two clamparm device hinged with a common nail clipper firmly fastened to protrude beyond one of these clamp bars. The inside of the other clamp bar has a guide groove channel. Molded or otherwise formed grips can be fastened to the exterior of the clamp bars to assure a firm grip. The lever arm of the common nail clipper is actuated by the larger leverage action of the clamp bars, inversely reducing the force necessary to nip the nail, employing simple principles of Physics. This simple solution avoids the complexity of scissor and plier-like action, crossed and hinged levers, and mini-hydraulic actions.

LEGEND OF DRAWING NUMBERS

PART
1 Top Clamp Bar
2 Bottom Clamp Bar
3 Rivet Hinge
4 Hinge Spacer (optional)
**5*a*** Finger Pad (Top)
**5*b*** Finger Pad (Bottom)
6 Nipper Bar (Top)
7 Nipper Bar (Bottom)
8 Front Guide Post
9 Actuating Lever
10 Rear Holding Rivet
11 File Bar
12 Washer Spacer (optional)
13 Friction Catch (Top)
14 Friction Catch (Bottom)
15 Return on Clamp Bar (optional)
16 Guide Groove Channel
17 Safe-fold End

DESCRIPTION OF THE PREFERRED EMBODIMENTS

Figure 1:
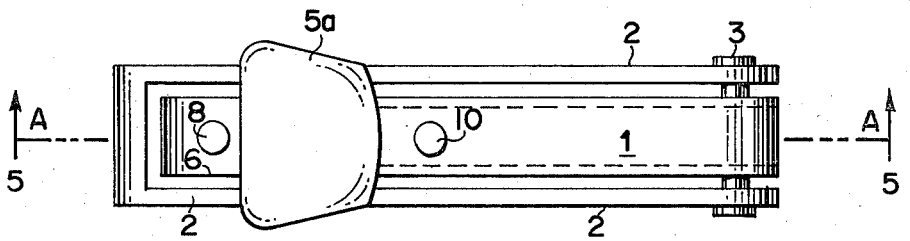
FIG. 1 is the Top View drawing of the Invention, showing the Finger Pad on the Top Clamp Bar (1) with the Top Nipper Bar (6) and the Safe-Fold End (17) in place.
Figure 2:
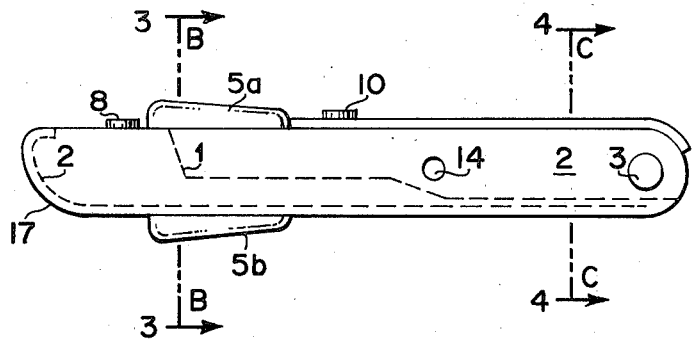
FIG. 2 is the Side View of the Invention in the safe-folded position when not in use.
Figure 3:
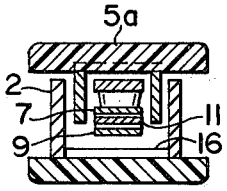
FIG. 3 is the X-Section of FIG. 2 along line B—B.
Figure 4:
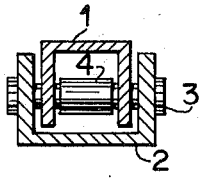
FIG. 4 is the Rear Section of FIG. 2 along Line C—C.
Figure 5:
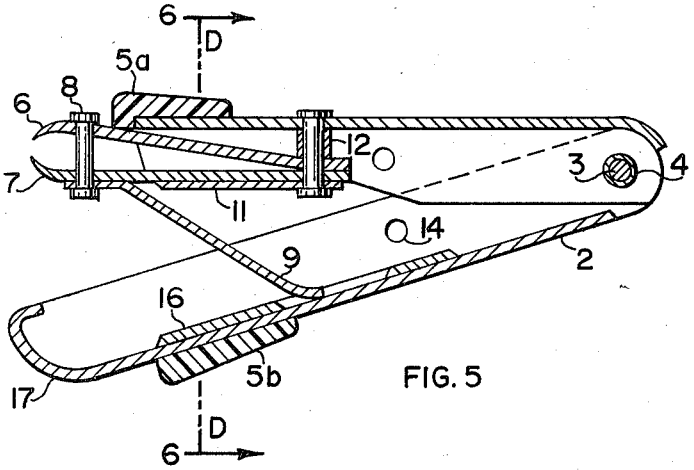
FIG. 5 is the Cross-Section of the Invention along Line A—A with the Clamp Bars (1 and 2) open, and the Actuating Lever (9) in place, ready to nip. Note that the Top File Bar (11) clears the top edge of the Clamp Bar so that it can be rotated outward to be used.
Figure 6:
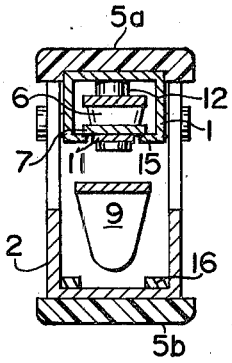
FIG. 6 is a Cross-Section of FIG. 5 along Line D—D.

As shown in FIGS. 1 to 6, the Invention consists of a simple clamp with top Clamp Bar (1) hinged at the rear to Bottom Clamp Bar (2) by the Rivet Hinge (3) with an optional Hinge Spacer (4). Parts 6–9, 11, which may be a stock common nail clipper, is securely fastened to the Clamp Bar by the Rear Holding Rivet (10) with an optional Washer Spacer (12).

Parts **5*a* and 5*b* are Finger Pads molded from plastic or formed otherways and fastened to the front ends of the Clamp Bars. Friction Catches (13 and 14**) are formed on the sides of the Clamp Bars to hold them together in a safe-fold position when the device is in the closed position.

Insofar as Parts 6 to 9 and 11 can be the assembled unit of a stock common nail clipper, only a brief description of the parts is made here. Parts 6 and 7 are the Nipper Bars fastened by rivet at the rear and by the Front Guide Post (8). The File Bar (11) and the Actuating Lever (9) rest over the Top Nipper Bar. To work the Nipper Bars (6 and 7) to nip the nail, the Actuating Lever (9) must be rotated from its rest position a full semi-circle around the Front Guide Post (8) and then flipped with its top side down and its end up in the air creating a lever arm which acts upon the front end of the Top Nipper Bar (6). Added leverage force is instilled when the Clamp Bar (2) is clamped over the end of the Actuating Lever (9) which will ride in the Guide Groove Channel (16) on the inside of the Clamp Bar (2).

Part 15 is an optional material Return on the Clamp Bar to hold the assembled nail clipper in place. It is not necessary as the pressure of the Actuating Lever (9) will normally force the nipper end down in place. The Rear Holding Rivet (10) with with an optional Washer Spacer (12) will normally hold the nipper assembly firmly in place. The top edge of the Top Nipper Bar (6) is flush with the top of the Top Nipper Bar (2) so that the File Bar (11) can be rotated outward when the file is being used.

Lengthening the Clamp Bars (1 and 2) as well as the Actuating Lever (9) will increase the leverage force in the case of a larger-dimensioned device, say, for a toe nail clipper. Likewise, the Top Nipper Clamp Bar (2) can be fabricated with the Nipper Edges (combining with Top Nipper Bar (6)) but it will be more expensive than using two Nipper Bars (6 and 7) of similar configuration and special instrument steel material.

We claim:

1. The invention of a new and improved Grip-Operated Finger and Toe Nail Clipper Unit comprising of a U-channeled Top Clamp Bar Unit hinged at one end to nestle into a second larger U-channeled Bottom Clamp Bar, with finger pads on the exterior face of both Top and Bottom Clamp Bars at the open end away from the hinge, and with a common Nail Clipper Unit of prior art consisting of a complete unit of two nipper bars with cutting edges at one end and riveted together at the other end with a rotateable file bar on the exterior face of one nipper bar, a front guide post to align the cutting edges of the nipper bars to meet when same are compressed by a loose actuating lever piece which is notched to seat in and rotate around the front guide post with same actuating lever so devised by prior art that it will lie flat over and covering the file bar when in the closed position or to actuate the cutting edges when in the open angled position, and with same common Nail Clipper Unit so riveted in the channel of the open end of the Top Clamp Bar so the cutting edges of the nipper bars will protrude beyond the finger pad, and with the bottom nipper bar flush with the bottom edge of the Top Clamp Bar so that the file bar of the Nail Clipper Unit can be rotated 90° outward to function as a file accessory, and with the Nail Clipper Unit held firmly in place when same is inserted and seated under the return edges of the ends of the Top Clamp Bar, all to form a new unit with new configuration so that the common Nail Clipper Unit can be actuated by a full hand-grip operated set of Top and Bottom Clamp Bars with a firmer grip and more ease and less effort.

2. The invention of claim 1 comprising all of the features and embodiments described above to include a Guide Groove Channel in the inside bed of the Bottom Clamp Bar to seat and guide the actuating lever of the Nail Clipper Unit when same is in the open angle nipping position, and making the Bottom Clamp Bar a new and longer lever applying added pressure to the actuating lever thus reducing the effort need to nip the nail under the cutting edges.

3. The invention of claim 1 comprising all of the features and embodiments described above and with a Bottom Clamp Bar whose length at the open end protrudes beyond the cutting edges of the Nail Clipper Unit when the Top Clamp Bar is closed and nestled within the Bottom Clamp Bar's U-channel, thus enclosing the Nail Clipper Unit completely and providing a safe-fold without any catching protrusions, and easily opened Clamp Bars with the aid of the finger pad protrusions.

* * * * *